United States Patent [19]

Seider

[11] 4,283,797

[45] * Aug. 18, 1981

[54] VIDEO BOW TIE

[76] Inventor: Murray Seider, 402 Ocean Pkwy., Brooklyn, N.Y. 11218

[ * ] Notice: The portion of the term of this patent subsequent to Aug. 18, 1985, has been disclaimed.

[21] Appl. No.: 343,037

[22] Filed: Feb. 6, 1964

[51] Int. Cl.[3] ..... A43D 25/02; G09F 21/02; F21L 15/14

[52] U.S. Cl. ..... 2/151; 40/586; 362/108; 40/129; 240/59

[58] Field of Search ..... 2/144, 151, 154; 240/59, 6; 40/129, 130

[56] References Cited

U.S. PATENT DOCUMENTS

| | | | |
|---|---|---|---|
| 2,430,607 | 11/1947 | Gaskowitz | 2/151 X |
| 2,510,323 | 6/1950 | Taborski | 2/151 |
| 2,578,269 | 12/1951 | Sinton | 2/151 |
| 2,641,766 | 6/1953 | Taborski | 2/151 |

*Primary Examiner*—Patrick D. Lawson

[57] ABSTRACT

1. A novelty bow necktie structure comprising a narrow strip of fabric folded into juxtaposed folds, a tube sleeved around the folds midway the ends thereof, an electric lamp structure supported and concealed within the confines of the tube, conductors connected at one end to the lamp structure, an electric battery connected to the other ends of the conductors, and a flexible band connected at one end to the fabric for fastening the strip around the neck of the wearer, the outer surface of the outermost fold having removable indicia thereon adapted to be illuminated by the lamp structure.

12 Claims, 13 Drawing Figures

VIDEO BOW TIE

This invention relates generally to wearing apparel and more particularly to new and useful improvements in a novelty necktie for use at exhibitions such as World's Fairs and the like.

A principal object of the present invention is to provide a bow necktie with a removable and replaceable indicia on the surface of the necktie.

Another object of the invention is to provide a bow necktie structure with removable and replaceable indicia on the surface of the necktie and with means for illuminating the surface of the necktie.

A further object of the invention is to provide a bow necktie structure with removable and replaceable indicia on the surface of the necktie and with built-in lamp bulbs connected to a source of electromotive force for illuminating ,he surface of the necktie.

Yet another object, according to a modification of the invention, is to provide a bow necktie with indicia on the surface thereof and with means for illuminating such indicia including a built-in source of electromotive force.

For further comprehension of the invention, and of the objects and advantages thereof, reference will be had to the following description and accompanying drawings, and to the appended claims in which the various novel features of the invention are more particularly set forth.

In the accompanying drawings forming a material part of this disclosure:

Figures 1, 2, 3, 4, 5, 6, 7:
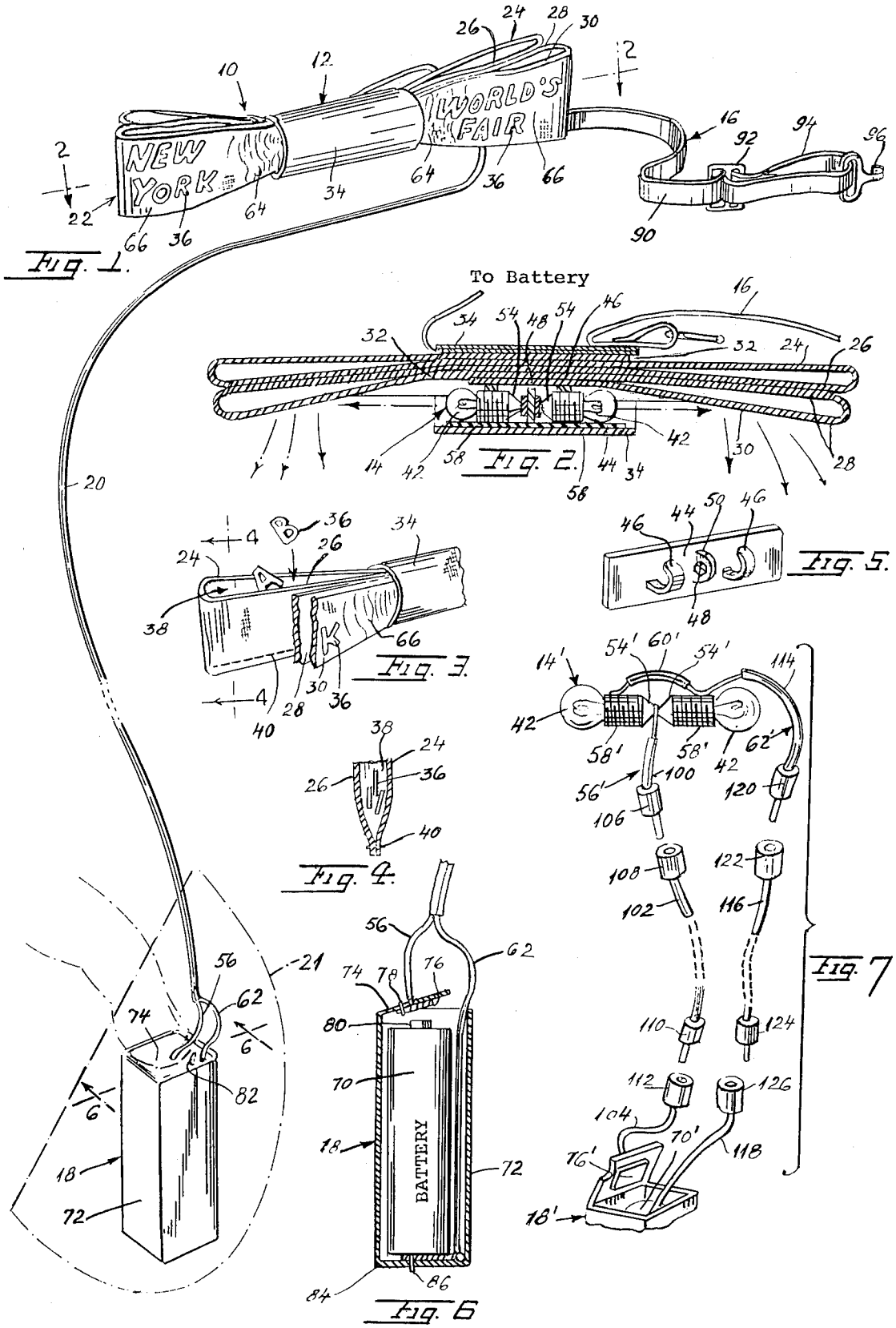
FIG. 1 is a front perspective view of a bow necktie structure and associated parts made in accordance with one form of the invention, part of the structure being shown diagrammatically in a pocket, parts being shown broken away.
FIG. 2 is a horizontal sectional view taken on the line 2—2 of FIG. 1.
FIG. 3 is a fragmentary perspective view of one end of the necktie, parts being shown broken away.
FIG. 4 is a vertical sectional view taken on the line 4—4 of FIG. 3.
FIG. 5 is a front perspective view of the lamp supporting board.
FIG. 6 is a vertical sectional view taken on the line 6—6 of FIG. 1.
FIG. 7 is a front elevational view of a modified form of lamp structure and battery connecting means.

Referring in detail to the drawings, in FIG. 1 a bow necktie structure made in accordance with one form of the invention is shown and designated generally by the numeral 10. The bow necktie structure consists broadly of a bow necktie 12, a built-in electric lamp structure 14, flexible means 16 for fastening the necktie around the neck of the wearer, and a source of electromotive force constituted by an electric battery unit 18 for energizing the lamps. The lamp structure and battery unit 18 are connected by an elongated cable 20 to permit the battery unit to be placed in the pocket 21 of the garment of the wearer of the necktie and hidden from view.

The bow necktie 12 per se consists of an elongated narrow strip 22 of fabric, silk or other suitable material folded transversely upon itself to form a number of folds in juxtaposed relation, four such folds being shown and numbered 24, 26, 28, 30, reading from the inside to the outside of FIG. 1. The ends 32 of the strip terminate midway the ends of the folds on both sides of the folded structure. A fabric tube 34 is sleeved around the folds midway the ends thereof, the tube being open at both ends.

In accordance with the invention, indicia 36 is placed on the outer surface of the outermost fold 30. This indicia is constituted by letters of the alphabet which are stored in a pocket 38 formed by sewing the bottom edges of the innermost pair of folds 24 and 26, as indicated at 40 in FIG. 3. The letters 36 may be formed of paper and may have adhesive on the rear surface thereof in order to stick them on the surface of the fold 30 as seen in FIG. 1. The wording formed by the letters will be at the pleasure of the wearer of the necktie, the wearer taking the desired letters out of the pocket 38 and pasting them on the outer surface of fold 30. For example, such wording may read "New York World's Fair" as seen in FIG. 1 or any other suitable wording. The letters are readily removed off the surface of fold 30 and returned to the pocket 38.

The built-in lamp structure 14 comprises a pair of electric lamps disposed in end-to-end relation with the lamp bulbs 42, 42 on the outside as viewed in FIG. 2. The lamp bulbs are carried by an insulating rectangular-shaped board 44, the lamps being removably seated in spaced metal hooks 46, 46 fixed to one surface of the board. An insulating lug 48 projects from the same surface of the board between the hooks and is formed with a central hole 50. A metal rivet 52 extends through the hole 50 and contacts the central terminals 54, 54 of the lamps. The rivet is soldered to one end of a conductor 56 leading to one side of the battery unit 18. The side bodies of the lamps constituting the side terminals 58, 58 are mechanically and electrically connected to each other by a wire 60, which wire is connected to one end of a conductor 62 leading to the other side of the battery unit. The board 44 with the connected lamps supported thereon is inserted lengthwise through an end of the tube 34 to the inside of the tube with the hooks 46, 46 and the lug 48 pressing against the midsection of the folded tie structure, pressing the folds into intimate contact with each other midway the ends thereof, the ends of the folds flaring outwardly into winged formation. The outermost fold 30 of the tie is folded lengthwise slightly as indicated at 64 adjacent the ends of the tube 34, the outermost end of the fold bearing the indicia 36 remaining flat as indicated at 66.

The battery unit 18 comprises a battery 70 encased in an insulating housing 72 open at the top. The top is adapted to be closed by a hinged lid 74. A metal contact 76 is secured to the bottom of the lid by a brad 78 and connected to the contact 76 is the bottom end of the conductor 56 which is connected to the central terminals 54, 54 of the lamp bulbs. Contact 76 is adapted to be moved into contact with the central terminal 80 of the battery in order to close the circuit through the lamps. The bottom end of conductor 62 extends through a notch 82 formed in the lid to the bottom of the battery where it is connected to a contact plate 84 secured to the bottom of the housing by a brad 86, the plate contacting the side of the battery.

The means 16 for fastening the necktie to the neck of the wearer includes a narrow flexible fabric band 90 passing through a buckle 92 to form an end loop 94 for adjusting the length thereof. A hooked clip 96 carried at the end of the loop is adapted to hook into an end of the tube 34 for fastening the necktie around the neck of the wearer.

In use, the bow necktie 10 is placed on the neck of the wearer and secured in position by the band 90. The battery unit 18 is concealed in a pocket of a garment such as a jacket with the cable 20 concealed under the folds of the jacket so that only the bow necktie 12 is visible. By merely manually pressing down on the lid 74 of the housing 72 of the battery unit in the pocket, the circuit through the lamps will be closed and the lamp bulbs 42, 42 will be illuminated, the light rays from the bulbs being directed outwardly of the ends of the tube 34 onto the longitudinal creases or folds 66 where they are deflected onto the indicia 36 on the outermost fold 30, thereby illuminating such indicia and affording wonderment to the viewers and entertainment to the wearer. The wording on the fold 30 can very readily be changed by removing the indicia 36 and substituting any other desired indicia thereon, the desired indicia being available in pocket 38 of the necktie.

In FIG. 7, a modified form of lamp structure 14' and means for adjusting the length of the cable connection between the lamp structure and battery unit 18' are shown. In this form, the end of the conductor 56' is placed between the end terminals 54', 54' and said end soldered to the terminals. The side terminals 58', 58' of the lamps are connected by a wire 60' similar to the form of FIG. 1, and the end of the wire 60' is connected to the conductor 62' similarly to FIG. 1. Conductor 56' leads to the center contact 76' and conductor 62' leads to the side terminal of the battery 70'. In this form, however, the lengths of the conductors 56' and 62' are made adjustable. For this purpose, the conductors are made sectional. Conductor 56' is formed of three sections 100, 102, 104. Sections 100 and 102 are adapted to be joined by a plug 106 on the end of section 100 and a socket 108 on the adjacent end of section 102. Sections 102 and 104 are adapted to be joined by a plug 110 on the other end of section 102 and a socket 112 on the adjacent end of section 104.

Conductor 62' is formed of three sections, namely, sections 114, 116, 118. Sections 114 and 116 are adapted to be joined by a plug 120 on the end of section 114 and a socket 122 on the adjacent end of section 116. Sections 116 and 118 are adapted to be joined by a plug 124 on the other end of section 116 and a socket 126 on the adjacent end of section 118. The sections 102 and 116 may be used or not as desired.

Figure 8:
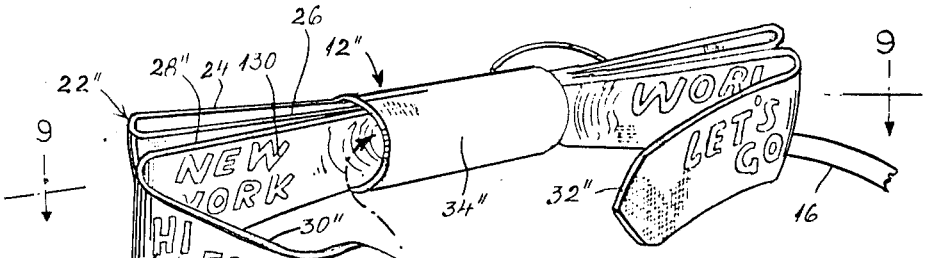
FIG. 8 is a view similar to FIG. 1 of a modified form of bow necktie structure, parts being omitted.
Figure 9:
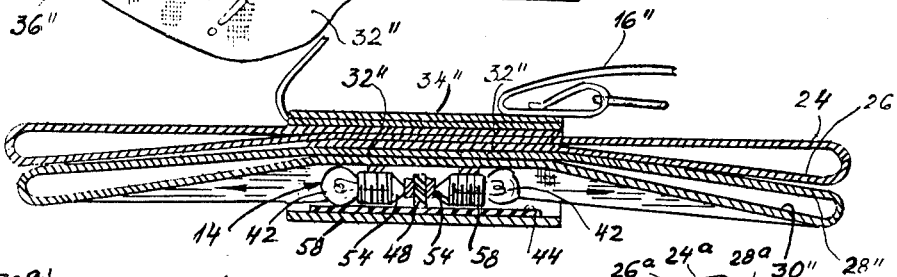
FIG. 9 is a horizontal sectional view taken on the line 9—9 of FIG. 8.
Figure 10:
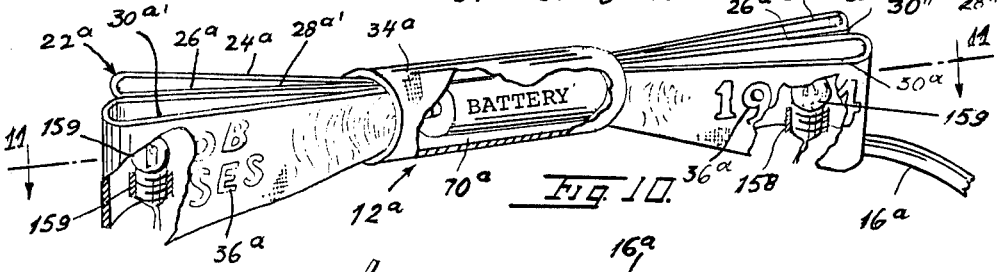
FIG. 10 is a front perspective view of a bow necktie structure embodying another modified form of the invention, parts being shown broken away and parts being omitted.

In FIGS. 8 and 9, a modified form of bow necktie 12'' is shown. This necktie 12'' differs from the necktie 12 of FIG. 1 merely in that the strip 22'' is so folded that the ends 32'', 32'' are inserted in the front of the tube 34'' in closely spaced end-to-end relation as shown in FIG. 9, instead of being disposed on both the front and rear of the folded structure. Furthermore, in this form indicia 130 is placed on the front surface of the third fold from the rear, to wit, fold 28'' and indicia 36'' is placed as well on the front surface of the foremost front fold 30''. By merely pulling the ends 32'', 32'' out of the tube 34'' and letting them hang loosely, the indicia on both folds 28'' and 30'' may be read. The indicia of the folds 28'' and 30'' preferably is different such as illustrated, wherein the indicia on fold 28'' reads "New York World's Fair" and the indicia on fold 30'' reads "Hi Folks Let's Go".

In all other respects, the bow necktie 12'' is similar to bow necktie 12 and similar reference numerals are used to indicate similar parts throughout.

Figure 11:
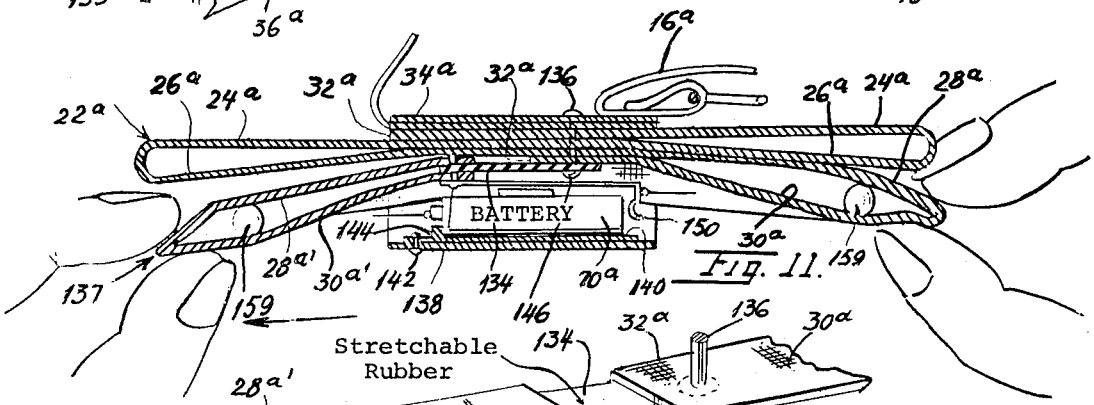
FIG. 11 is a horizontal sectional view taken on the line 11—11 of FIG. 10.
Figure 12:
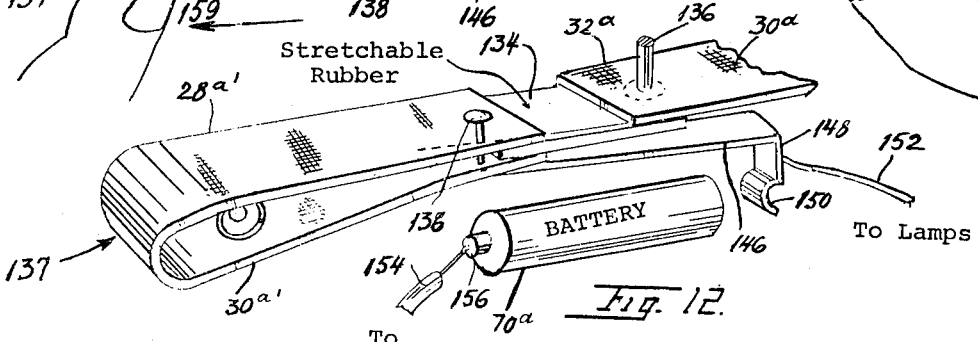
FIG. 12 is an enlarged disassembled perspective view of the battery and associated parts shown in FIG. 10.

Referring now to the modification of the invention shown in FIGS. 10 to 13, inclusive, herein the bow necktie **12*a* comprises the strip 22*a* folded transversely in such a manner as to form four folds 24*a*, 26*a*, 28*a*, 30*a* at one end of the folded structure and only two folds 24*a*, 26*a* at the other end of the folded structure. The folds on both sides of the center are looped in wing formation, with spaces between the folds. The ends 32*a*, 32*a* of the strip are disposed at the front and back of the folded structure. A tube 34*a* is sleeved around the folds with the ends of the strip disposed inside the tube. A rectangular stretchable strip 134 is juxtaposed over the front end 32*a* of the strip and a double headed rivet 136 passes through the folds, one end of the strip 134 and the back of the tube 34*a* thereby clamping the folds and ends between the tube and strip 134. A shorter strip 137 of similar material as strip 22'' is folded transversely upon itself in front of and in juxtaposition to the folds 24*a*', 26*a*', at the other end of the folded structure, forming folds 28*a*', 30*a*'. The ends of strip 137 are disposed on both sides of the other end of rubber strip 134 and are fastened thereto by a rivet 138. By reason of this construction, upon grasping the outer ends of folds 28*a*, 30*a* and the outer ends of folds 28*a*', 30*a*' by the fingers of the hands as seen in FIG. 11, the strip 134 may be stretched longitudinally by pulling on the folds 28*a*', 30*a*', the strip 134 being stretched longitudinally and the folds 28*a*', 30*a*' moved outwardly away from the tube 34*a*** for a purpose to be presently described.

An electric battery **70*a* is disposed in the tube 34*a* in horizontal position on a pad 140 secured to the tube by a rivet 142. The pad is formed with an upright flange 144 at one end which is adapted to engage the end of the battery and prevent longitudinal movement of the battery. A busbar 146 is disposed above and along the battery with one end secured to the joint between the folds 28*a*', 30*a*' and the end of the rubber strip 134 by the rivet 138. The other end of the busbar is formed with a downwardly extending flange 148 terminating in a curved contact member 150 disposed adjacent to and in alignment with one end of the battery 70*a*. One end of a conductor 152 is connected to the flange 148. Another conductor 154 is connected at one end to the central terminal 156** at the other end of the battery.

Figure 13:
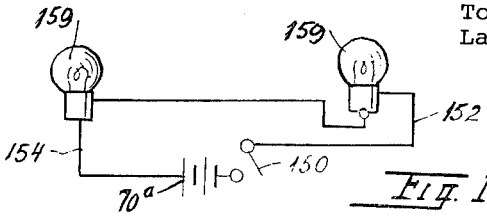
FIG. 13 is a view showing the electric circuit of the parts of FIG. 10.

In accordance with this form of the invention, electric lamp sockets 158 are suitably secured to the inner surfaces of fold **28*a*' at one end of the folded structure and to the inner surface of fold 28*a* at the other end of the folded structure. An electric lamp 159 is mounted in each socket 156 is upright position. The other ends of the conductors 152 and 154 are operatively connected to the lamps as shown in the diagram of FIG. 13**.

In use, the bow necktie **12*a* is fastened around the neck of the wearer by a band 16*a* similar to band 16. By merely grasping the outer ends of the folds 28*a*, 30*a* and 28*a*', 30*a*' and pulling outwardly on the ends of folds 28*a*', 30*a*', the rubber strip 134 will stretch outwardly in the direction of the pull thereby carrying the busbar 146** in the same direction, until the contact member 150 formed thereon will contact the terminal of the battery 70*a* and close the circuit through the lamps 159 whereby the lamps become illuminated thereby illuminating the indicia 36*a* on the front surface of the folds 30*a*', 30*a*.

While I have illustrated and described the preferred embodiments of my invention, it is to be understood that I do not limit myself to the precise constructions herein disclosed and that various changes and modifications may be made within the scope of the invention as defined in the appended claims.

Having thus described my invention, what I claim as new, and desire to secure by United States Letters Patent is:

1. A novelty bow necktie structure comprising a narrow strip of fabric folded into juxtaposed folds, a tube sleeved around the folds midway the ends thereof, an electric lamp structure supported and concealed within the confines of the tube, conductors connected at one end to the lamp structure, an electric battery connected to the other ends of the conductors, and a flexible band connected at one end to the fabric for fastening the strip around the neck of the wearer, the outer surface of the outermost fold having removable indicia thereon adapted to be illuminated by the lamp structure.

2. A novelty bow necktie structure comprising a narrow strip of fabric folded into juxtaposed folds, a tube sleeved around the folds midway the ends thereof, an electric lamp structure supported and concealed within the confines of the tube, conductors connected at one end to the lamp structure, an electric battery connected to the other ends of the conductors, and a flexible band connected at one end to the fabric for fastening the strip around the neck of the wearer, the outer surface of the outermost fold having removable indicia thereon adapted to be illuminated by the lamp structure, two of the folds defining a pocket for storing a supply of indicia elements.

3. A novelty bow necktie structure comprising a narrow strip of fabric folded into juxtaposed folds, a tube sleeved around the folds midway the ends thereof, an electric lamp structure supported and concealed within the confines of the tube, conductors connected at one end to the lamp structure, an electric battery connected to the other ends of the conductors, and a flexible band connected at one end to the fabric for fastening the strip around the neck of the wearer, the outer surface of the outermost fold having removable indicia thereon adapted to be illuminated by the lamp structure, the outermost fold being creased longitudinally adjacent both ends of the tube whereby the rays from the lamps are directed upon the indicia.

4. A novelty bow necktie structure comprising a narrow strip of fabric folded into juxtaposed folds, a tube sleeved around the folds midway the ends thereof, an electric lamp structure supported and concealed within the confines of the tube, conductors connected at one end to the lamp structure, an electric battery connected to the other ends of the conductors, and a flexible band connected at one end to the fabric for fastening the strip around the neck of the wearer, the outer surface of the outermost fold having removable indicia thereon adapted to be illuminated by the lamp structure, an insulated housing for said battery, said housing having an open top end, a lid hinged to the top end of the housing for closing said open top end, a movable electric contact carried by said lid connected to one of said conductors, the central terminal of said battery being in the path of manual movement of said movable contact whereby the circuit is closed through the lamp structure.

5. A novelty bow necktie structure comprising a narrow strip of fabric folded into juxtaposed folds, a tube sleeved around the folds midway the ends thereof, an electric lamp structure supported and concealed within the confines of the tube, conductors connected at one end to the lamp structure, an electric battery connected to the other ends of the conductors, and a flexible band connected at one end to the fabric for fastening the strip around the neck of the wearer, the outer surface of the outermost fold having removable indicia thereon adapted to be illuminated by the lamp structure, an insulated housing for said battery, said housing having an open top end, a lid hinged to the top end of the housing for closing said open top end, a movable electric contact carried by said lid connected to one of said conductors, the central terminal of said battery being in the path of manual movement of said movable contact whereby the circuit is closed through the lamp structure, the outermost fold being creased longitudinally adjacent both ends of the tube whereby the rays from the lamps are directed upon the indicia.

6. As an article of manufacture, a novelty bow necktie construction comprising a narrow strip of fabric folded into juxtaposed folds, a tube sleeved around the folds midway the ends thereof, removable indicia operatively supported on the outer surface of the outermost fold, and a flexible band connected at one end to the strip for fastening the strip around the neck of the wearer, and a pocket formed within the confines of the folds for storing indicia therein.

7. A novelty bow necktie structure comprising a narrow strip of fabric folded into juxtaposed folds, a tube sleeved around the folds midway the ends thereof, an electric lamp structure supported and concealed within the confines of the tube, said lamp structure including a pair of lamps disposed horizontally in end-to-end relation, an electric battery, conductors connecting the battery with the central and side terminals of the lamps, and a flexible band connected at one end to the strip for fastening the strip around the neck of the wearer, the outer surface of the outermost fold having removable indicia thereon adapted to be illuminated by the lamp structure.

8. A novelty bow necktie structure comprising a narrow strip of fabric folded into juxtaposed folds, a tube sleeved around the folds midway the ends thereof, an electric lamp structure supported and concealed within the confines of the tube, said lamp structure including a rectangular insulating board inside the tube, a pair of lamps disposed horizontally in end-to-end relation on said board, an electric battery, conductors connecting the battery with the central and side terminals of the lamps, and a flexible band connected at one end to the strip for fastening the strip around the neck of the wearer, the outer surface of the outermost fold having removable indicia thereon adapted to be illuminated by the lamp structure.

9. A novelty bow necktie structure comprising a narrow strip of fabric folded into juxtaposed folds, a tube sleeved around the folds midway the ends thereof, an electric lamp structure supported and concealed within the confines of the tube, an electric battery, conductors connecting the battery with the lamp structure, and a flexible band connected at one end to the strip for fastening the strip around the neck of the wearer, the ends of said strip constituting the outermost front fold being inserted in end-to-end relation inside the tube, said outermost front fold and the fold adjacent thereto having removable indicia on the outer surfaces thereof.

10. A novelty bow necktie structure comprising a narrow strip of fabric folded into juxtaposed folds, a tube sleeved around the folds midway the ends thereof, an electric lamp structure supported and concealed within the confines of the tube, said lamp structure including a pair of electric lamps disposed horizontally in end-to-end relation, an electric battery, conductors connecting the battery with the central and side terminals of the lamps, and a flexible band connected at one end to the fabric for fastening the strip around the neck of the wearer, the outer surface of the outermost fold having removable indicia thereon adapted to be illuminated by the lamp structure, said conductors being sectional for adjusting the length thereof, the sections being joined by plug and socket connections.

11. A novelty bow necktie structure comprising a narrow strip of fabric folded upon itself into juxtaposed folds, the ends of the strip disposed on both sides of the folded structure, a rectangular rubber strip having one end secured to one end of the strip, said one ends of the rubber and fabric strips and said folds being riveted to the tube, another strip of fabric folded upon itself into juxtaposed folds, the ends of said latter strip fastened to the other end of the rubber strip, said folds being closely spaced from each other, electric lamp structures built into said folds, an electric battery built into said tube, and operative means of connection between the battery and said electric lamp structures whereby said lamp structures are illuminated, the outer surface of the outermost front folds having indicia thereon adapted to be illuminated by said lamp structures.

12. A novelty bow necktie structure comprising a narrow strip of fabric folded upon itself into juxtaposed folds, the ends of the strip disposed on both sides of the folded structure, a rectangular rubber strip having one end secured to one end of the strip, said one ends of the rubber and fabric strips and said folds being riveted to the tube, another strip of fabric folded upon itself into juxtaposed folds, the ends of said latter strip fastened to the other end of the rubber strip, said folds being closely spaced from each other, electric lamp sockets in the spaces between the folds at the outer ends thereof, electric lamps operatively mounted in said sockets, an electric battery mounted and concealed in said tube, and operative means of connection between the battery and said sockets and lamps for illuminating said lamps, the outer surfaces of the outermost front folds having indicia thereon adapted to be illuminated by said lamps.

* * * * *